US007102102B2

(12) United States Patent
Godil et al.

(10) Patent No.: US 7,102,102 B2
(45) Date of Patent: Sep. 5, 2006

(54) HEATER ASSEMBLY INCLUDING THERMAL FUSE

(75) Inventors: Amin M. Godil, Vancouver, WA (US); Larry E. Hindman, Woodburn, OR (US)

(73) Assignee: Xerox Corporation, Stamford, CT (US)

( * ) Notice: Subject to any disclaimer, the term of this patent is extended or adjusted under 35 U.S.C. 154(b) by 374 days.

(21) Appl. No.: 10/754,141

(22) Filed: Jan. 9, 2004

(65) Prior Publication Data

US 2005/0151817 A1 Jul. 14, 2005

(51) Int. Cl.

| | |
|---|---|
| ***G03G 15/20*** | (2006.01) |
| ***B41J 2/01*** | (2006.01) |
| ***B41J 2/38*** | (2006.01) |
| ***H05B 3/02*** | (2006.01) |
| ***H05B 3/26*** | (2006.01) |

(52) U.S. Cl. ..... 219/216; 219/530; 219/541; 399/95; 399/298; 347/102

(58) Field of Classification Search ..... None
See application file for complete search history.

(56) References Cited

U.S. PATENT DOCUMENTS 5,389,958 A * 2/1995 Bui et al. ..... 347/103
5,406,321 A * 4/1995 Schwiebert et al. ..... 347/102
5,502,476 A * 3/1996 Neal et al. ..... 347/103
5,614,933 A * 3/1997 Hindman et al. ..... 347/103
5,619,240 A * 4/1997 Pong et al. ..... 347/103
5,691,756 A * 11/1997 Rise et al. ..... 347/102
5,856,650 A * 1/1999 Rise et al. ..... 219/216
5,860,052 A * 1/1999 Ohtsuka et al. ..... 399/329
6,161,930 A * 12/2000 Asano ..... 347/102
6,428,158 B1 * 8/2002 Szlucha ..... 347/102
6,713,728 B1 * 3/2004 Justice et al. ..... 219/469
6,734,397 B1 * 5/2004 Kato et al. ..... 219/216

* cited by examiner

*Primary Examiner*—Joseph Pelham
(74) *Attorney, Agent, or Firm*—Fay, Sharpe, Fagan, Minnich & McKee, LLP

(57) ABSTRACT

A heater assembly heats media substrate in a printing system prior to imprinting a desired image on the substrate. A plate member engages the substrate and communicates thermal energy thereto for the heating. A laminar assembly is adhered to the plate member and includes a trace pattern for converting electrical energy to the thermal energy. A thermal storage member is interposed between the plate member and the trace pattern for distributing thermal energy throughout the thermal storage member. Two thermal fuses are serially connected, one at each end of the trace pattern and disposed relative to the thermal storage member for detecting an undesired temperature increase in the laminar assembly sufficient for opening the fuses and electrically isolating the heater assembly against a consequential thermal run-away causing insulation degradation and an electrical short between the trace pattern and the plate member.

15 Claims, 4 Drawing Sheets

HEATER ASSEMBLY INCLUDING THERMAL FUSE

BACKGROUND

The present exemplary embodiments relate to printing or copying systems and, in particular, printing devices which utilize an intermediate transfer service such as a transfer drum which is intended to engage a receiving medium such as paper for imparting a desired image from the drum to the medium. The subject embodiments are especially applicable to printing devices which utilize a supply of colored inks to be communicated to a print head for document printing wherein the inks are supplied as solid ink sticks which must be heated to a liquid form before communication to the print head. Such systems are commercially available under the PHASER® mark from Xerox Corporation. The heating of the ink to effect the solid-to-liquid phase change is usually associated with corresponding heating of other components of the assembly, such as the drum and the medium itself before engagement with the drum. The subject embodiments are particularly directed to the structure and method of operation of the heater for the preheating of the medium prior to the transfer process.

All printers and copying machines have to be designed with an appreciation that at some time a power control failure may occur within the system and that such failure should not expose an operator or a repairman to a dangerous situation such as exposure to electrical shock or thermal burning. Indeed, a typical safety requirement (UL required) is that any component that has line voltage and is accessible by a user or operator must have enough insulation protection to have a dielectric strength of at least 3 KV between the user accessible parts, ground plane, secondary circuits and the line. This safety regulation must be met not only by new componentry but also by componentry that has been exposed to thermal run-away conditions that can damage the insulation.

The subject embodiments concern the operation and assembly of a medium preheater in a printing system, which preheater is a typical component subject to the above safety requirements. The conventional construction of such a heater involves a pattern of heat traces laminated to a metallic support plate. The support plate is disposed to engage the medium for the heating of the medium immediately prior to its engagement with the intermediate transfer drum and the imparting of a desired image from the drum to the medium. Laminating of the heat traces to the support plate involves insulating a layer therebetween which under normal use conditions would satisfy the 3 KV dielectric strength requirement. However, the heat traces in such a system are typically capable of reaching relatively extreme temperatures (about 1200° C.) which is a temperature that is easily capable of burning away an insulating layer between the heat traces and the support plate. The plate would then function as a ground plane for the electrical supply to the traces thereby grounding the line voltage to the component. Such an occurrence would fail to meet the above-referenced safety requirements.

There is a need for a heater assembly which is properly fused to interrupt this supply of electrical power to the heater in the event of a thermal run-away and at a point in time prior to the thermal run-away causing unacceptable damage to the pattern of heat traces themselves and/or the insulating layer separating the heat traces from the metallic support plate.

The present exemplary embodiments satisfy this need as well as others to provide a power control system for medium heaters in phasing printing systems that can provide the desired safety protection against power control failures that may cause thermal run-aways in the system.

BRIEF DESCRIPTION

A printing system is provided wherein a transfer drum imparts a desired image on a medium for imprinting the image on the medium. A heater is provided for preheating the medium to a selected temperature prior to the imprinting for facilitating reception of the image on the medium from the drum. The heater preferably includes two fuses, one fuse on the line lead and the other on the neutral lead, for interrupting a supply of power to the heater upon an undesired increase in the power supply and consequent overheating of the heater. The heater comprises a pattern of heat traces bonded to a support plate. The fuses are disposed in electrical series with the pattern of heat traces for opening the power supply circuit upon the opening of the fuses. The fuses comprise thermal fuses. A thermal storage member is associated with the pattern of heat traces and disposed relative to the fuses for communicating the thermal energy increase to the extent to open the fuses before more damaging thermal run-away.

DETAILED DESCRIPTION

Figure 1:
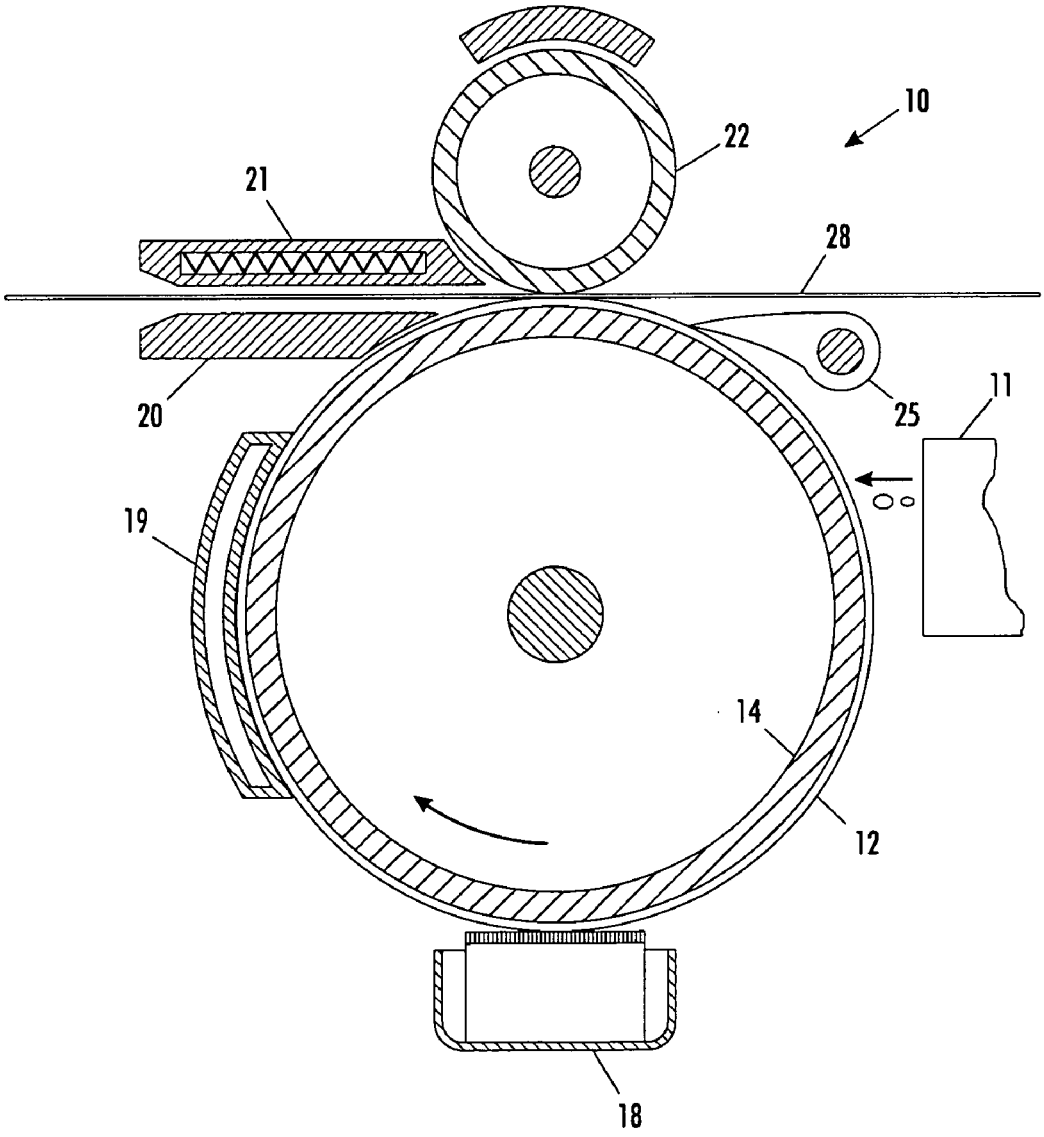
FIG. 1 is a diagrammatical illustration of a substantial portion of one of the embodiments particularly illustrating the disposition of the medium heater relative to an intermediate transfer drum.

FIG. 1 discloses a diagrammatical illustration of a printing system 10 wherein an ink image is transferred from an intermediate transfer surface, e.g., transfer drum 14, to a final receiving substrate 28, e.g., a medium such as paper, transparency or the like. A print head 11 is supported by an appropriate housing and support elements (not shown) for either stationary or moving utilization to place an ink in the liquid or molten state on the intermediate transfer surface 12 of transfer drum 14. Other shown basic elements of the assembly include applicator assembly 16 for applying a liquid layer forming the intermediate transfer surface 12 on the exterior of the drum 14, a print head 11, a drum heater 19, stripper fingers 25 for removing the substrate from the transfer surface 12, a guide 20 for guiding the substrate 28 through the system and fixing roller 22 for pressing the substrate 28 against the drum 14. The construction and operation of a printing system employing these basic elements is well known to one of ordinary skill in the art.

Of particular importance for the subject application is the construction and operation of the heater 21 for preheating the substrate 28 prior to imprinting of the desired image thereon from the transfer drum 14.

Figure 2:
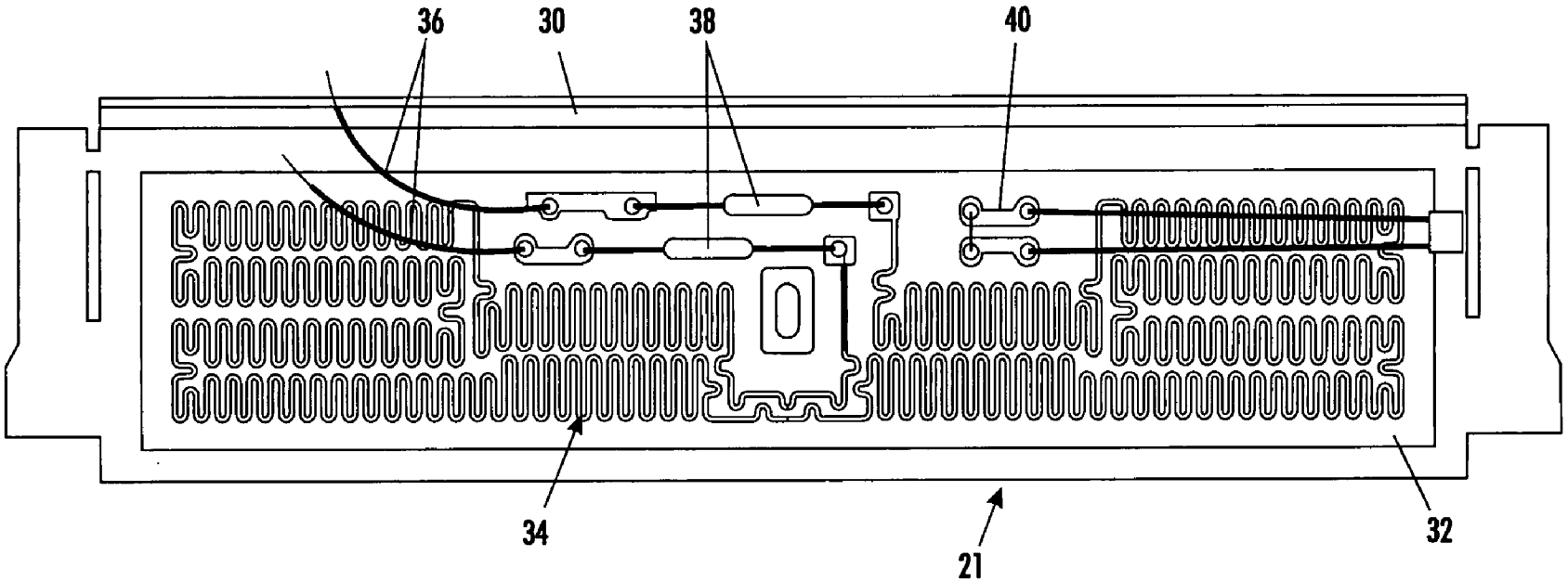
FIG. 2 is a planar view of a medium preheater.

With particular reference to FIG. 2, the support plate is comprised of a metallic, preferably aluminum, plate 30 having a relatively smooth surface for allowing a relatively frictionless slide of the substrate or medium 28 across it and for imparting enough thermal energy for heating the medium 28 to about 60° C. The drum is maintained at a similar temperature. Such temperatures facilitate the printing process. The development of thermal energy within the plate 30 is accomplished through a laminar assembly 32, including a pattern of heat traces 34 serially connected to the power leads 36, comprising a line lead and a neutral lead. A thermistor 40 is used to monitor the temperature of the heater 21 at the desired temperature for the proper heating of the medium 28 during normal operation. The traces 34 are interposed between the thermal fuses 38 and the leads 36 for interrupting the supply of power to the traces in the event of an undesired temperature increase such as may be caused by a thermal run-away. Thermal run-away would occur when the power supply to the heater 21 suffers a power control failure. For example, a triac switch (not shown) is usually employed to supply the power to the heater 21 and in the event of a triac failure or software problem, so much current can be supplied to the heater 21 that the heater trace 34 can burn up resulting in permanent damage to the trace and an insulation layer between the trace and the plate 30. In such cases, a short may exist between the heater trace 34 and the plate thereby exposing an operator or user to an electric shock from a contact with the plate 30. If power is still applied to either or only one end of the heater trace, the circuit could still be connected to ground through the breached insulation, hence the Ul requirement for double insulation. Accordingly, the present embodiment comprises an assembly, which will insure opening of both fuses 38 in the case of an electrical run away.

Figure 3:
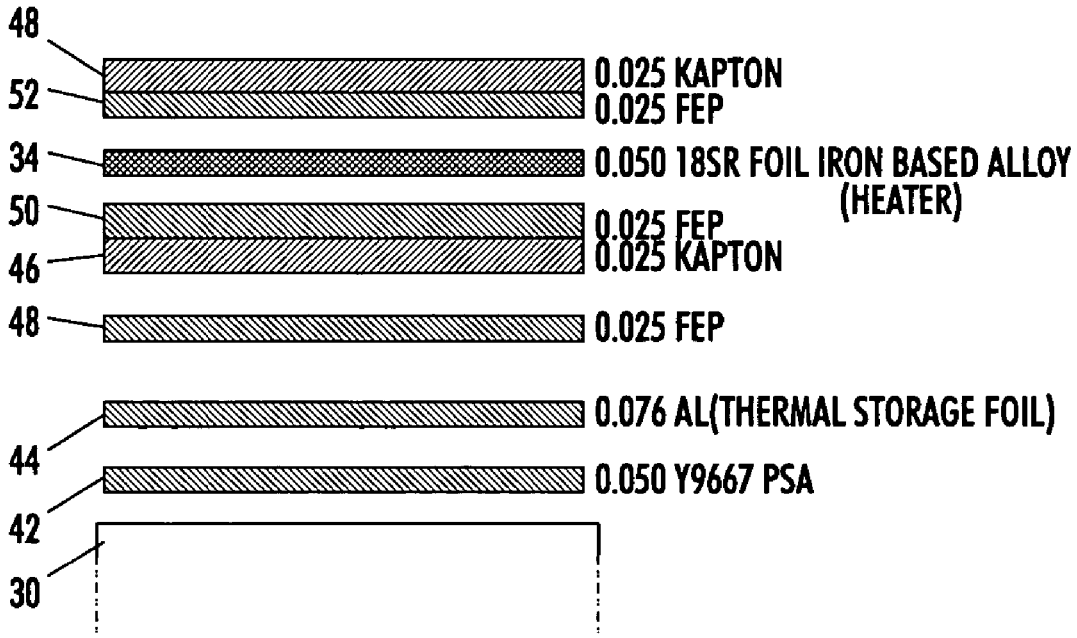
FIG. 3 is an expanded cross sectional stack up of one embodiment of preheater material layup.

With reference to FIG. 3, a material stack up of the heater assembly is shown in exploded cross section. The stack up starts with the metallic plate 30 which will actually engage the medium. The plate 30 is insulated from the thermal storage member 44 by insulating material 42, preferably comprising a single layer of Kapton 46 disposed between the heater foil traces 34 and the aluminum foil 44. This assembly provides the dielectric strength of 3 KV as required by the product specifications.

The heater foil 44 operates to disperse thermal energy generated by the traces 34 in two directions, both towards the plate 30 and back towards the fuses 38 as will be explained more in detail later. The foil 44 is adhered to insulating layer 46 by adhesive 48. Heat traces 34, are sandwiched between insulating layers 46, 48 and adhered thereto by adhesive layers 50, 52. The construction of the assembly is accomplished by intimately co-curing foil 44 with the remaining layers of the assembly and then adhering the heater 32 to the plate 30.

Figure 4:
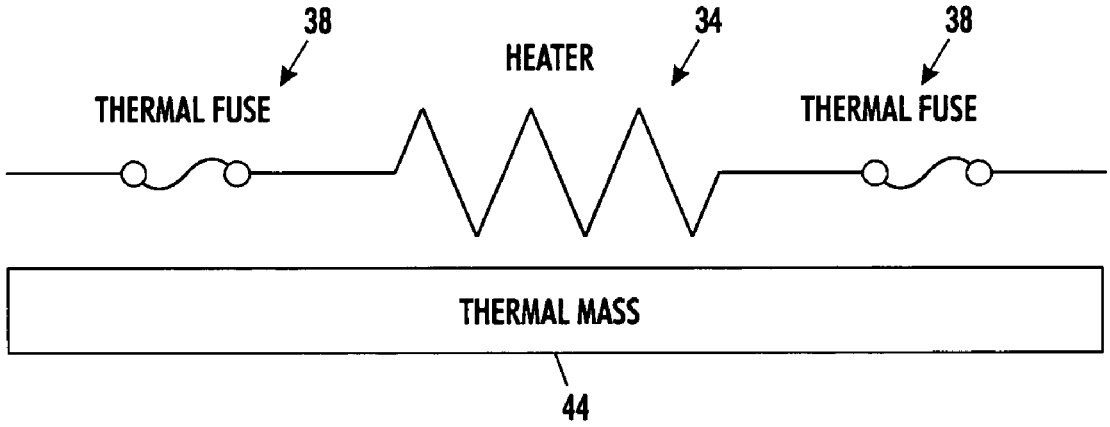
FIG. 4 is a diagrammatical illustration of a preheater assembly.

As noted above, the overall objective of the subject embodiments is to provide a thermal mass 44 that will provide sufficient energy (a thermal flywheel) to assure that the second thermal fuse will open after the first fuse opened, dielectrically isolating both ends of the heater from electrical power, see FIG. 4. Because of its placement and reduced mass relative to the heater plate 30 mass, mass 44 will experience a temperature change more rapidly than mass 30 and also due to its thermal isolation from mass 30 it will also maintain an elevated temperature longer after electrical power is removed. In a situation of unfused thermal run-away, it is possible for the traces to reach temperatures up to 1300° C. which is clearly enough to melt most conventional insulating materials.

In one embodiment though, the insulating dielectric material 42 between the traces 34 and the support plate 30 is robust enough to avoid thermal degradation during such a trace melt down. In this embodiment storage foil 44 would be unnecessary, but the expense of putting a significant enough thermal resistance between the traces 34 and the plate 30 would cause a thickness in the dielectric which would be expected to cause a significant rise in heater costs. In addition, the thermal insulation and resistance between the traces 34 and the plate 30 would cause a reduction in efficiency of thermal communication to the plate 30. However, the thermal run-away would be significant enough to cause the opening of the fuses 38 prior to degradation of the insulating layer 42 and a resulting short between the traces and the plate.

A second embodiment of the invention comprises the inclusion of the thermal storage foil 44 between the traces 34 and the plate 30. In this embodiment, thermal run-away in the pattern of heat traces 34 is expeditiously communicated from the areas of the foil immediately contiguous to the pattern of heat traces to the area contiguous to the thermal fuses 38. It should be kept in mind that the foil 44 is intended to be coplanar with the overall heater area 32, and not just with the immediate area of the heat traces 34. In other words, those areas which are more densely formed with heat trace patterns will have increased temperature rises during thermal run-away than areas not so close to the traces, i.e., the location of the fuses 38. Accordingly, foil 44 will communicate thermal energy so generated in the areas immediately adjacent the traces to the areas of the foil near the fuses 38. In addition, during thermal run-away it is conceivable that the insulation and adhesive layers 46, 48, 50 between the heater trace 34 and the foil 44 could be so degraded due to thermal burn up that a short may occur between the foil and the traces. In such circumstances, the power to the traces will not be serially interrupted as the foil may itself serve as the necessary serial conductor. However, the continuous ramp up of the temperature in such a situation will eventually communicate enough temperature to the area of the foil contiguous to the fuses 38 so that the fuses will open and electrical energy to the traces will be interrupted so the traces are electrically isolated and unable to effect a short to the plate 30.

In another embodiment, the foil 44 is not interposed between the plate 30 and the heat trace 34 but is disposed adjacent to insulating layer 48, i.e., essentially on top of the trace and intermediate the trace pattern 34 and the fuses 38 for an even more efficient communication of thermal run-away to the fuses 38. However, the embodiment of FIG. 3 has the operational advantage of improvement in the overall thermal performance of the heater 32 by better dispersing the thermal energy from the heat trace 34 to the foil 44 and then to the plate 30. This particular structure allows the heater to operate at a higher power density, making the heater 32 effectively smaller and less costly than the alternative designs.

The subject embodiments operate to satisfy the safety requirements to avoid a ground short between user accessible parts, even in the case of thermal run-away conditions.

The exemplary embodiments have been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A printing system wherein a transfer drum imparts a desired image on a medium for imprinting the image on the medium, and including a heater for preheating the medium to a selected temperature prior to the imprinting for facilitating reception of the image on the medium from the drum, the heater comprising a pattern of heat traces bonded to a support plate, the plate being disposed in the printing system for engaging the medium for effecting the heating of the medium to the selected temperature, and including a fuse disposed in electrical series with the pattern of heat traces for interrupting a supply of power to the heater upon an undesired increase in the supply and consequent overheating of the heater; and, wherein the heat traces are connected to the supply of power with a line lead and a neutral lead, and the fuse comprises first and second fuses respectively connected to the line lead and the neutral lead.

2. The printing system as claimed in claim 1 wherein the fuses comprise thermal fuses.

3. The printing system as claimed in claim 2 wherein a thermal storage member is associated with the pattern of heat trace and disposed relative to the fuses for opening both the fuses upon the consequent overheating.

4. The printing system as claimed in claim 3 wherein the thermal storage member comprises a foil disposed for communicating a thermal run-away of the pattern of heat traces to both of the fuses connected in series with the heat traces.

5. The printing system as claimed in claim 4 wherein the heater includes an insulator for electrically insulating the foil from the support plate, and the fuses are disposed relative to the foil for the opening of the fuses upon the thermal run-away.

6. The printing system as claimed in claim 5 wherein the pattern of heat traces comprises an iron based alloy foil and the thermal storage member comprises an aluminum foil.

7. The printing system as claimed in claim 4 wherein the foil is disposed relative to the support plate for communicating thermal energy from the pattern of heat traces to the support plate whereby enhanced power density of the pattern can be realized.

8. The printing system as claimed in claim 4 wherein the foil is spaced from the pattern of heat traces by a first insulator, and the foil is spaced from the support plate by a second insulator.

9. The printing system as defined in claim 8 wherein the second insulator is configured for maintaining an insulating integrity upon the thermal run-away and before the opening of the fuse for precluding an electrical short between the heat traces and the support plate.

10. A heater assembly for heating media substrate in a printing system prior to imprinting a desired image on the substrate comprising:

a plate member for engaging the substrate and communicating thermal energy thereto;

a laminar assembly adhered to the plate member including a trace pattern for converting electrical energy to the thermal energy and a thermal storage member interposed between the plate member and the trace pattern for distributing the thermal energy throughout the thermal storage member; and, first and second fuses serially connected to the trace pattern and disposed relative to the thermal storage member for detecting an undesired temperature increase in the laminar assembly sufficient for opening the fuse and electrically isolating the heater assembly against an electrical short between the trace pattern and the plate member.

11. A heater assembly for heating media substrate in a printing system prior to imprinting a desired image on the substrate comprising:

a plate member for engaging the substrate and communicating thermal energy thereto;

a laminar assembly adhered to the plate member including a trace pattern for converting electrical energy to the thermal energy and a thermal storage member interposed between the plate member and the trace pattern for distributing the thermal energy throughout the thermal storage member wherein the thermal storage member comprises a foil insularly disposed between the trace pattern and the plate member; and, a thermal fuse serially connected to the trace pattern and disposed relative to the thermal storage member for detecting an undesired temperature increase in the laminar assembly sufficient for opening the fuse and electrically isolating the heater assembly against an electrical short between the trace pattern and the plate member.

12. The heater assembly of claim 11 wherein a first insulator insulates the foil from the trace pattern and a second insulator insulates the foil from the plate member, the first insulator being configured for thermal degradation in the thermal run-away prior to a thermal degradation of the second insulator.

13. The heater assembly of claim 12 wherein the fuse is configured for opening prior to the thermal degradation of the second insulator.

14. A heater assembly for heating media substrate in a printing system prior to imprinting a desired image on the substrate comprising:

a plate member for engaging the substrate and communicating thermal energy thereto;

a laminar assembly associated with the plate member including a trace pattern for converting electrical energy to the thermal energy;

a fuse serially connected to the trace pattern; and, means for communicating an undesired increase in temperature in the laminar assembly to the fuse for opening the fuse and electrically isolating the trace pattern from the electrical energy prior to generation of an electrical short between the trace pattern and the plate member comprising a foil insularly disposed between the plate member and trace pattern and configured to maintain electrical insulation therebetween before the opening of the fuse.

15. The heater assembly of claim 14 including a first insulator between the foil and the trace pattern and a second insulator between the foil and the plate member, the second insulator being configured to preclude an electrical short between the foil and the plate member upon thermal degradation of the first insulator due to thermal run-away and prior to the opening of the fuse.

* * * * *